US012551038B2

(12) United States Patent
Clarke

(10) Patent No.: US 12,551,038 B2
(45) Date of Patent: Feb. 17, 2026

(54) ARM PILLOW

(71) Applicant: Corey Clarke, Florida, NY (US)

(72) Inventor: Corey Clarke, Florida, NY (US)

( * ) Notice: Subject to any disclaimer, the term of this patent is extended or adjusted under 35 U.S.C. 154(b) by 159 days.

(21) Appl. No.: 18/386,636

(22) Filed: Nov. 3, 2023

(65) Prior Publication Data

US 2025/0143492 A1 May 8, 2025

(51) Int. Cl.
*A47G 9/10* (2006.01)

(52) U.S. Cl.
CPC ..... *A47G 9/10* (2013.01); *A47G 9/1009* (2013.01); *A47G 2009/1018* (2013.01); *A47G 9/1027* (2013.01); *A47G 9/1036* (2013.01); *A47G 9/1045* (2013.01); *A47G 9/1054* (2013.01); *A47G 9/1063* (2013.01)

(58) Field of Classification Search
CPC ..... A47G 9/10; A47G 9/1009; A47G 2009/1018; A47G 9/1027; A47G 9/1036; A47G 9/1045; A47G 9/1054; A47G 9/1063; A47G 9/1072; A47G 9/1081; A47G 9/109
USPC ..... 5/636, 490
See application file for complete search history.

(56) References Cited

U.S. PATENT DOCUMENTS 4,393,520 A 7/1983 Koch
4,864,669 A * 9/1989 Jones ..... A47G 9/0253 5/636
5,168,590 A * 12/1992 O'Sullivan ..... A61F 7/02 5/639
6,918,148 B2 7/2005 Auxila
D819,367 S 6/2018 Meinhart
11,013,347 B1 5/2021 Sawick
2003/0019007 A1* 1/2003 Spencer ..... A47C 16/04 2/24
2009/0222993 A1 9/2009 Villanueva
2011/0088168 A1* 4/2011 Haynesworth ..... A47G 9/10 5/652
2011/0252567 A1* 10/2011 Yu ..... A47G 9/10 5/640
2012/0174320 A1 7/2012 White Thomas
2012/0278992 A1* 11/2012 Ou ..... A47G 9/0253 5/638
2013/0117939 A1 5/2013 Moss
2015/0314844 A1* 11/2015 Sellmeyer ..... B63C 9/30 441/125
2018/0352965 A1 12/2018 Douglas

FOREIGN PATENT DOCUMENTS

WO WO2018231970 12/2018

* cited by examiner

*Primary Examiner* — Justin C Mikowski
*Assistant Examiner* — Deborah Talitha Gedeon

(57) ABSTRACT

A pillow assembly for supporting objects on a user's arm without impeding blood circulation through the arm includes a main body comprising a resiliently compressible material. Rigid blocks are coupled to a top side of the main body, and inserts are mounted atop the rigid blocks. The main body is bent to surround the arm with the inserts. Loads may be exerted on the pillow assembly through the main body, rigid blocks, and inserts while the pillow assembly is worn by the arm to support the loads on the arm without limiting blood flow.

7 Claims, 10 Drawing Sheets

ARM PILLOW

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pillows and more particularly pertains to a new pillow for supporting objects on a user's arm without impeding blood circulation through the arm.

(2) Description of Related Art Including Information Disclosed Under 37 CFR 1.97 and 1.98

The prior art relates to various pillows worn on an individual's arm for supporting babies or other objects. However, the prior art does not describe such an apparatus which includes rigid members surrounded by cushioning members which wraps around the individual's arm to prevent constriction of blood vessels in the arm. Such an apparatus would advantageous over the prior art by providing means for distributing a load resting on the arm via rigid members while cushioning both the arm and the load.

BRIEF SUMMARY OF THE INVENTION

An embodiment of the disclosure meets the needs presented above by generally comprising a main body which is elongated and comprises a resiliently compressible material configured for cushioning an arm of a user. A plurality of blocks is coupled to a top side of the main body, and each block of the plurality of blocks comprises a rigid material. A plurality of inserts is mounted opposite the main body across the plurality of blocks. The main body is bendable around a central longitudinal axis into a folded configuration wherein each insert of the plurality of inserts is positioned across a gap formed by the main body opposite another insert of the plurality of inserts.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
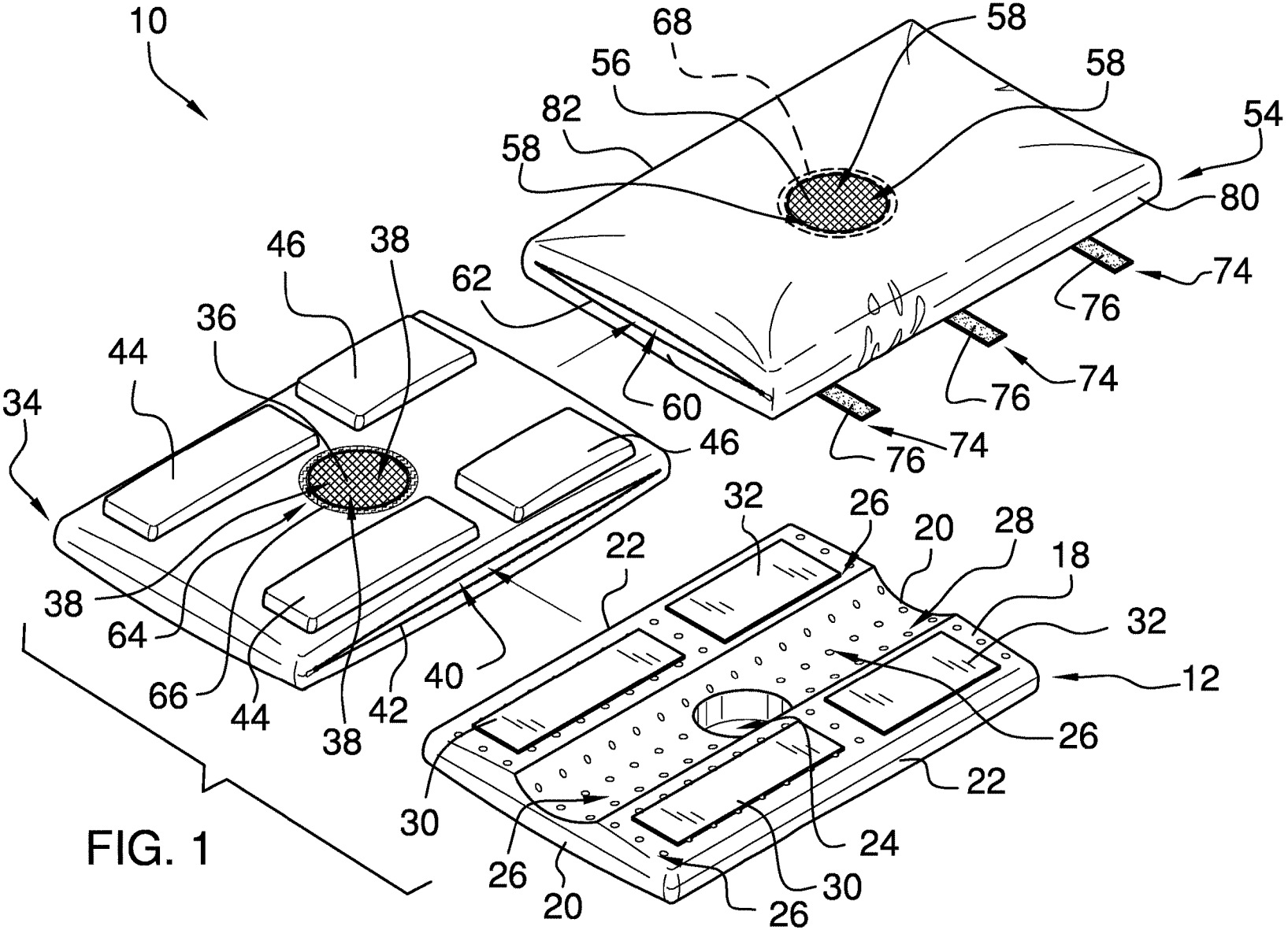
FIG. 1 is an exploded perspective view of a pillow assembly according to an embodiment of the disclosure.
Figure 2:
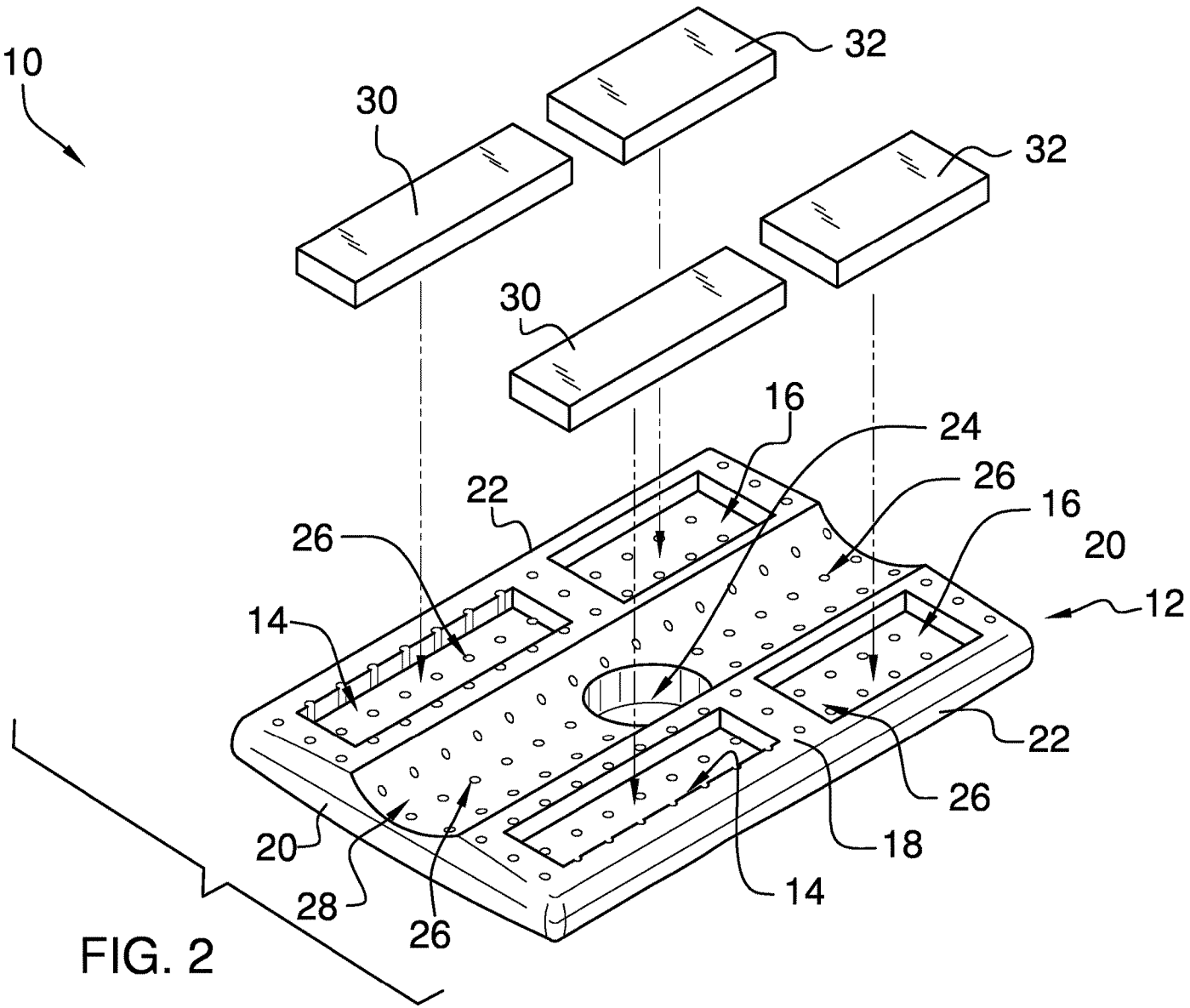
FIG. 2 is an exploded perspective view of a main body and a plurality of blocks of an embodiment of the disclosure.
Figure 3:
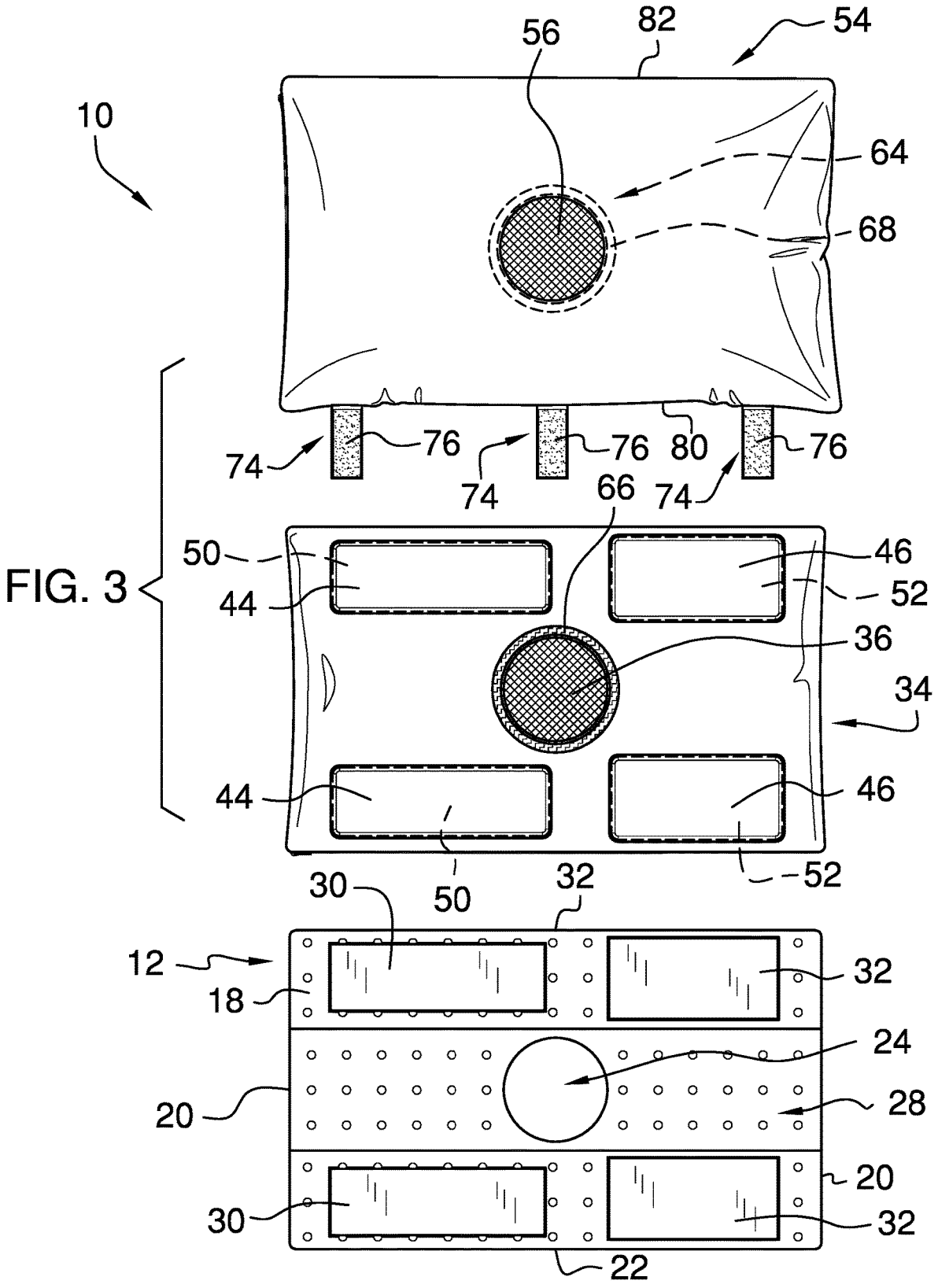
FIG. 3 is a top kit view of an embodiment of the disclosure.
Figure 4:
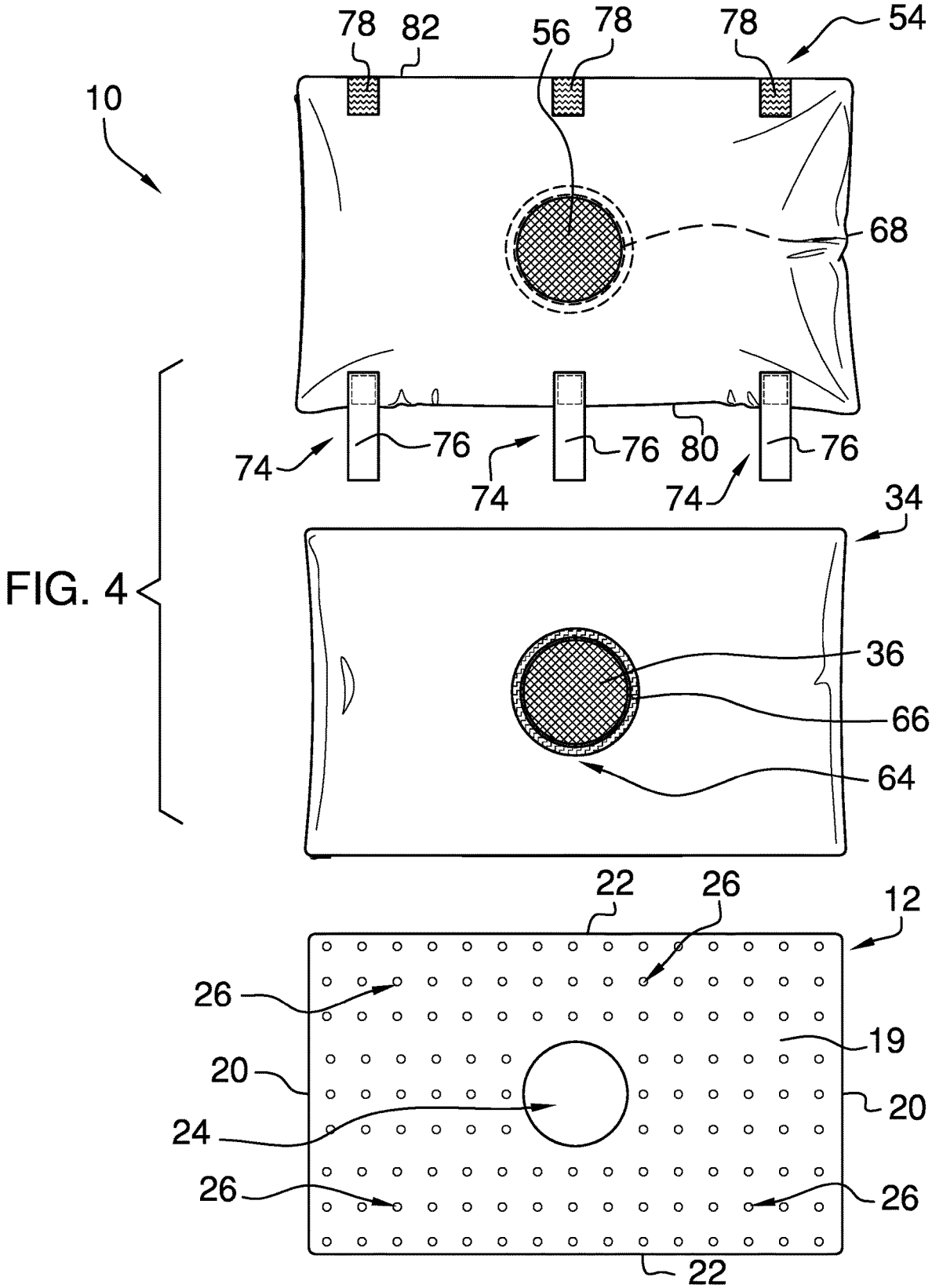
FIG. 4 is a bottom kit view of an embodiment of the disclosure.
Figure 5:
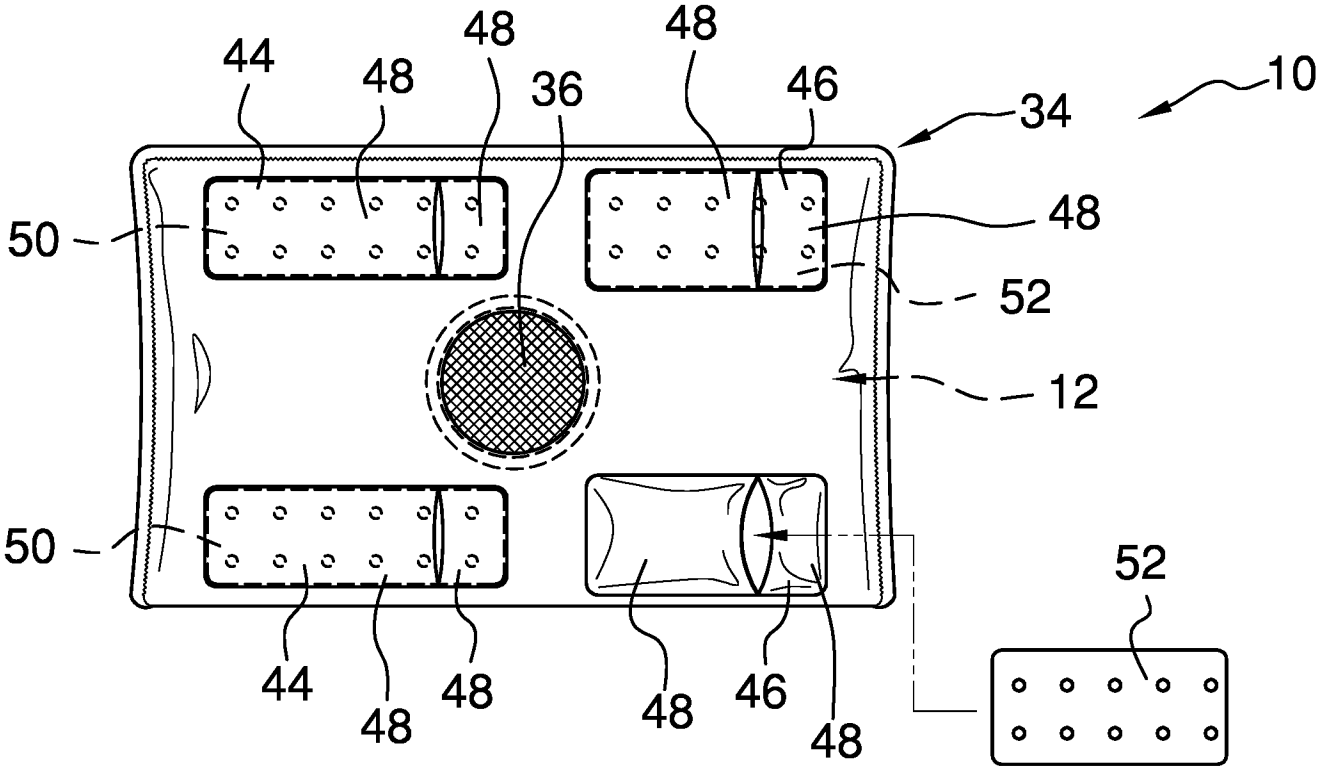
FIG. 5 is a top view of an embodiment of the disclosure with an outer casing removed.
Figure 6:
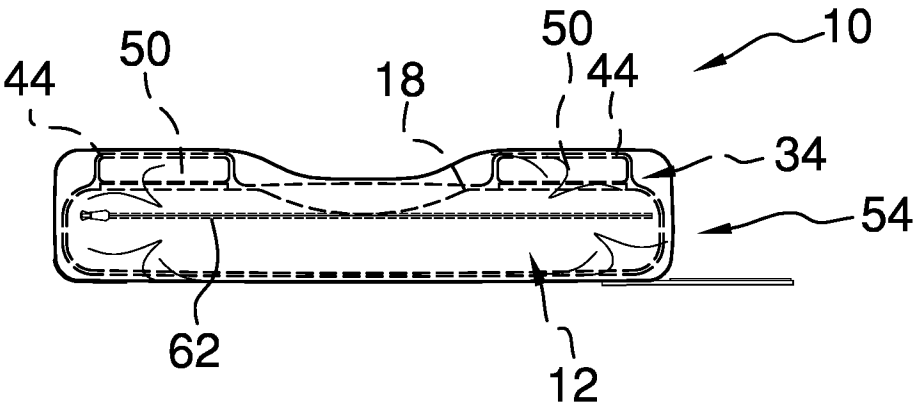
FIG. 6 is a front view of an embodiment of the disclosure.
Figure 7:
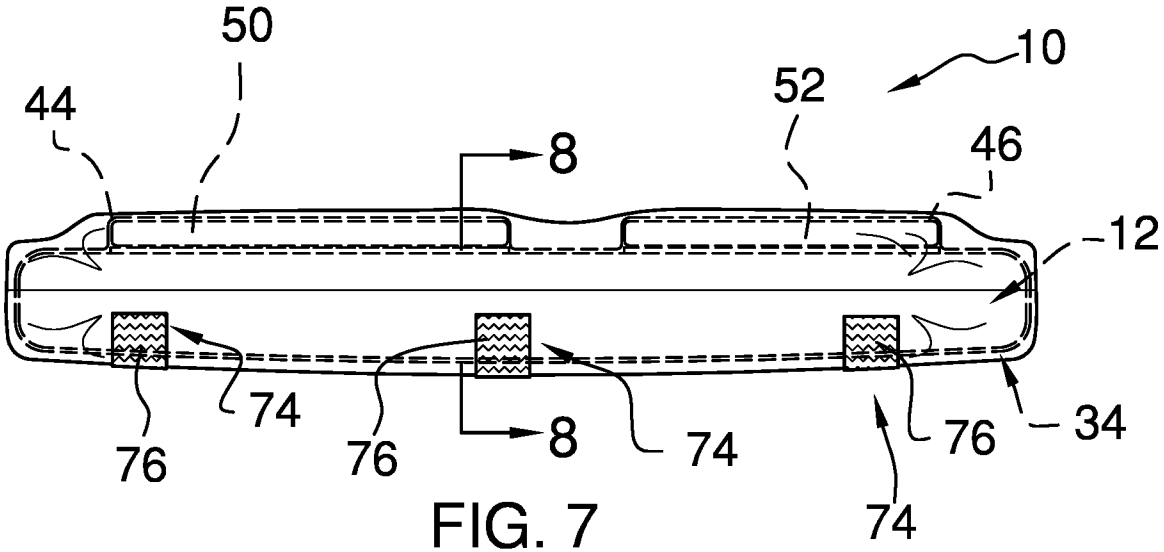
FIG. 7 is a side view of an embodiment of the disclosure.
Figure 8:
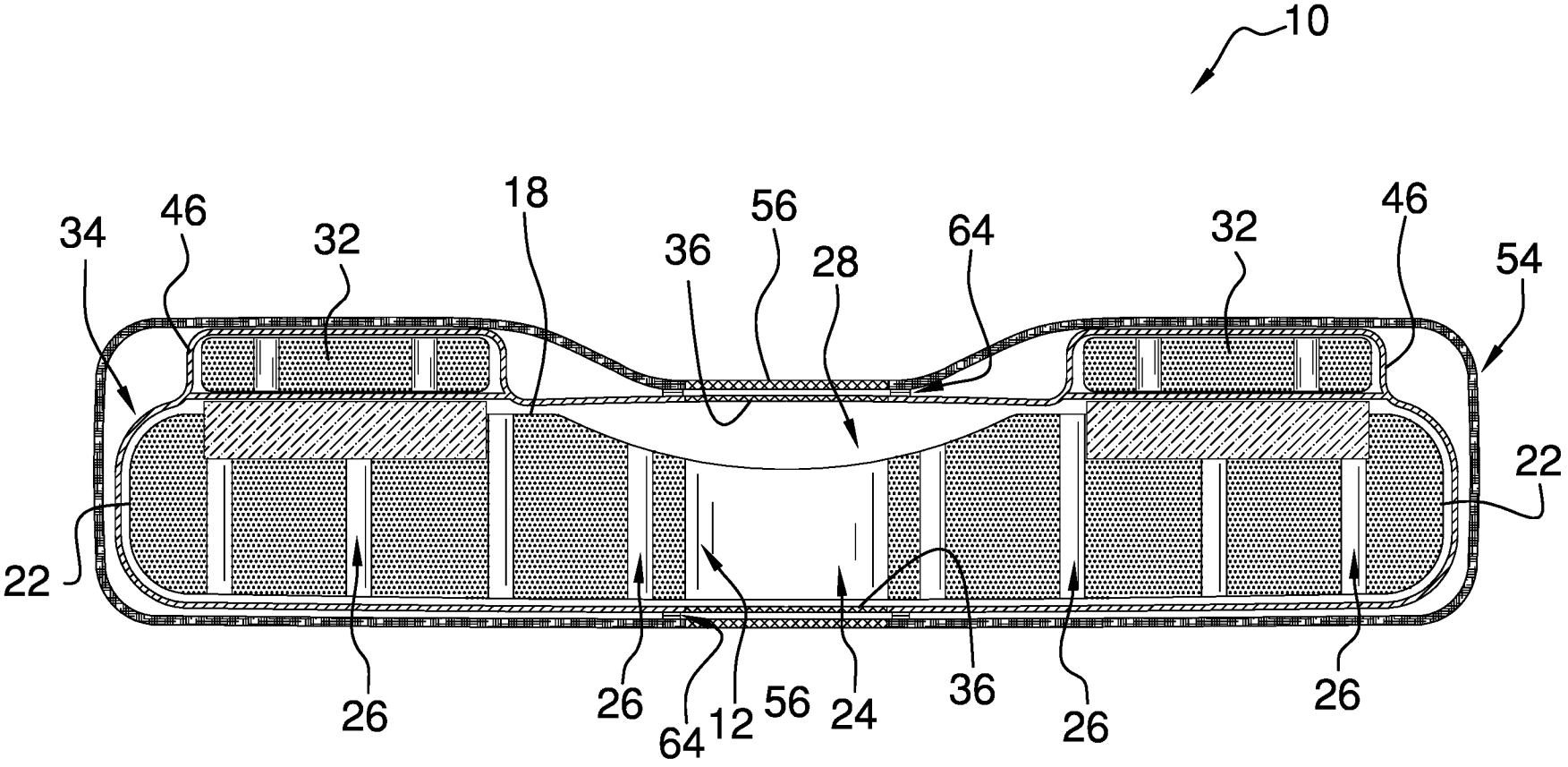
FIG. 8 is a cross-section view of an embodiment of the disclosure taken from Arrows 8-8 in FIG. 7.
Figure 9:
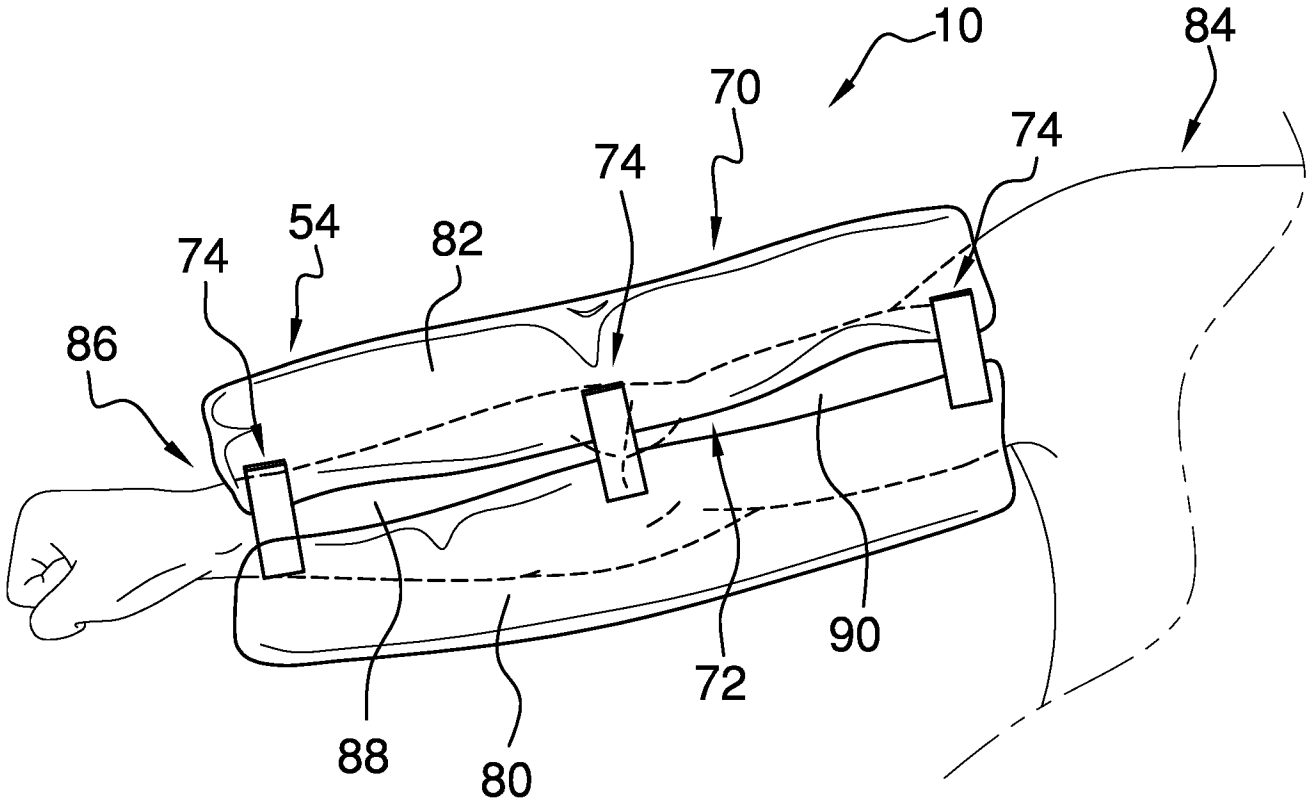
FIG. 9 is a front in-use view of an embodiment of the disclosure.
Figure 10:
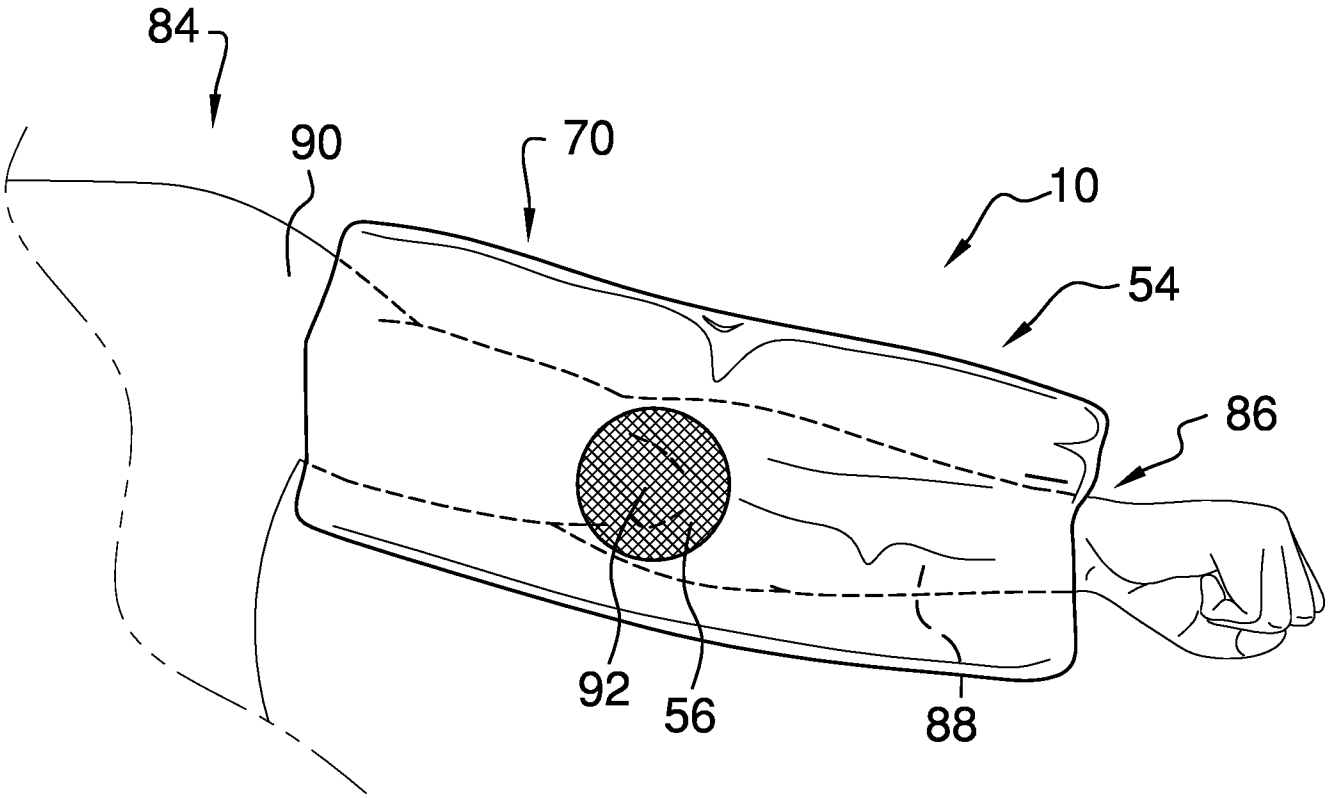
FIG. 10 is a back in-use view of an embodiment of the disclosure.
Figure 11:
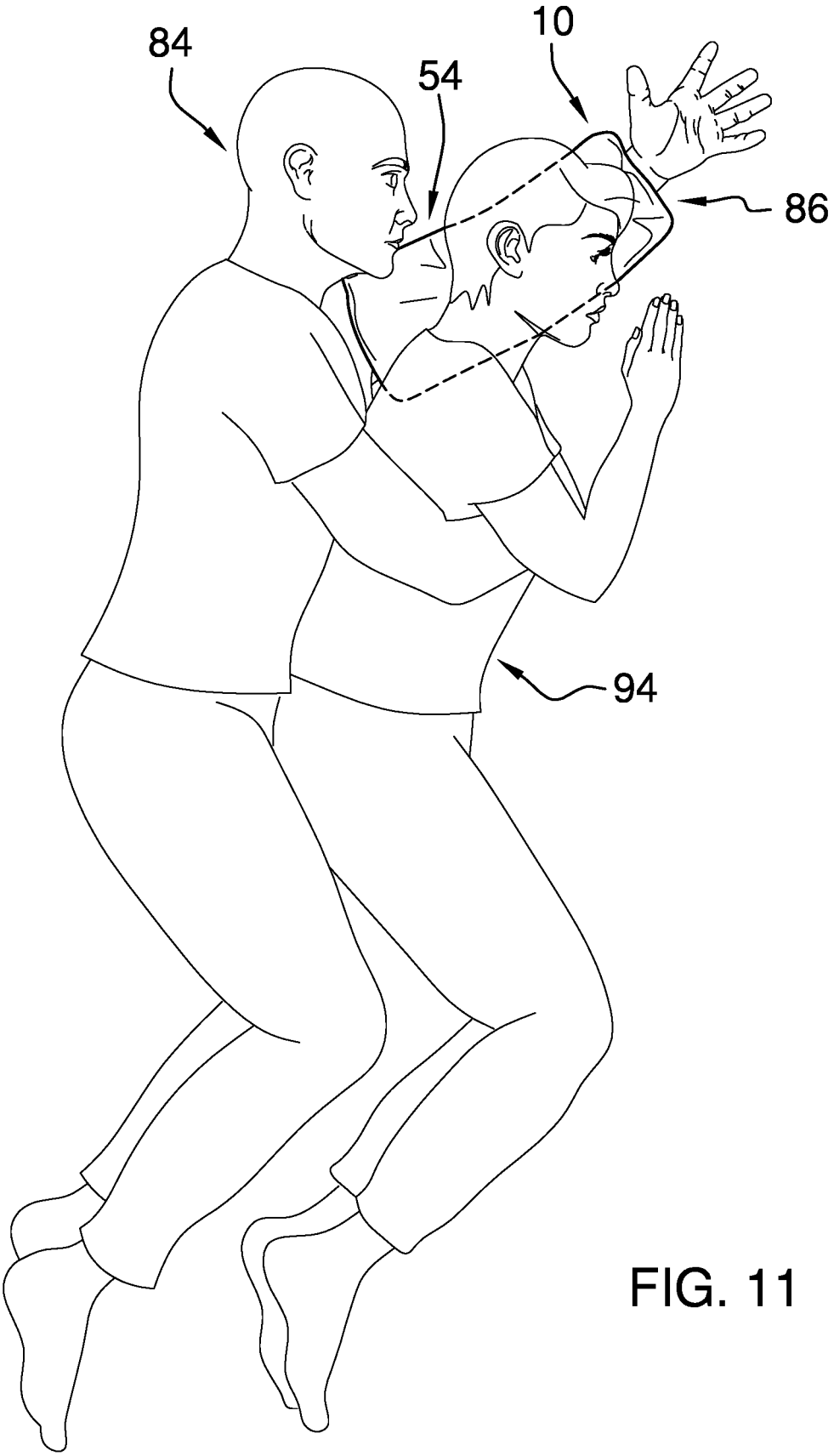
FIG. 11 is an in-use view of an embodiment of the disclosure.

With reference now to the drawings, and in particular to FIGS. 1 through 11 thereof, a new pillow embodying the principles and concepts of an embodiment of the disclosure and generally designated by the reference numeral 10 will be described.

As best illustrated in FIGS. 1 through 11, the pillow assembly 10 generally comprises a main body 12 having a resiliently compressible material configured for cushioning an arm 86 of a user 84. The main body 12 is elongated and defines a plurality of cavities, including a pair of first cavities 14 and a pair of second cavities 16, which extend into a top side 18 of the main body 12. The first cavities 14 are laterally spaced from each other with respect to the main body 12, and the second cavities 16 are laterally spaced from each other with respect to the main body 12. The pair of first cavities 14 is also longitudinally spaced from the pair of second cavities 16 with respect to the main body 12. The main body 12 defines a groove 28 in the top side 18 which extends longitudinally with respect to the main body 12. The groove 28 also extends between the pair of first cavities 14 and between the pair of second cavities 16. The main body 12 defines a central hole 24 which extends through the top side 18 and a bottom side 19 of the main body 12. The central hole 24 is positioned centrally between a pair of lateral sides 22 of the main body 12 and between a pair of ends 20 of the main body 12. The main body 12 also defines a plurality of through holes 26 which extend through the top side 18 and the bottom side 19. The through holes 26 are evenly dispersed across the top side 18 of the main body 12. Each through hole 26 of the plurality of through holes 26 is smaller than the central hole 24. The central hole 24 and the through hole 26 facilitate airflow through the central hole 24 and the through holes 26 to provide ventilation during use of the pillow assembly 10. The resiliently deformable material may comprise a foamed polymer, fabric, or the like. Bamboo may be incorporated into the resiliently deformable material such that the main body 12 is hypoallergenic. Other hypoallergenic materials may also be used in the main body 12.

A plurality of blocks is coupled to the top side 18 of the main body 12. The plurality of blocks includes a pair of first blocks 30 and a pair of second blocks 32. Each first block 30 of the pair of first blocks 30 is positioned in an associated first cavity 14 of the pair of first cavities 14, and each second block 32 of the pair of second blocks 32 is positioned in an associated second cavity 16 of the pair of second cavities 16. Each block of the pair of first blocks 30 and the pair of second blocks 32 comprises a rigid material. The rigid material may be acrylic, wood, or the like. Any material suitable for distributing a compressive force over an area and resisting deformation from the compressive force may be used.

An inner casing 34 encloses the main body 12 and the plurality of blocks. The inner casing 34 comprises a pair of inner casing ventilated sections 36 positioned on opposing ends of the central hole 24 of the main body 12. The inner casing ventilated sections 36 define inner casing apertures 38 configured to facilitate air flow through the pair of inner casing ventilated sections 36. The inner casing 34 also defines an inner casing opening 40 which extends into an interior volume of the inner casing 34. The main body 12 and the plurality of blocks are removable from within the inner casing 34 through the inner casing opening 40. An inner casing closure 42 is coupled to the inner casing 34 for closing the inner casing opening 40. The inner casing closure 42 comprises a zipper but may comprise snap buttons, a drawstring, a hook-and-loop fastener, or the like.

A plurality of pockets, including a pair of first pockets 44 and a pair of second pockets 46, is coupled to an exterior of the inner casing 34. The pair of first pockets 44 is positioned over the pair of first blocks 30, and the pair of second pockets 46 is positioned over the pair of second blocks 32. Each pocket of the pair of first pockets 44 and the pair of second pockets 46 comprises a pair of overlapping panels 48 which are positionable to selectively access an interior of each pocket. Each pocket of the pair of first pockets 44 and the pair of second pockets 46 may also include a closure such as a zipper, a snap button, a hook-and-loop fastener, or the like.

A plurality of inserts, including a pair of first inserts 50 and a pair of second inserts 52, is positioned in the plurality of pockets. Each first insert 50 of the pair of first inserts 50 is positioned in an associated first pocket 44 of the pair of first pockets 44, and each second insert 52 of the pair of first inserts 50 is positioned in an associated second pocket 46 of the pair of second pockets 46. Each insert of the pair of first inserts 50 and the pair of second inserts 52 comprises the resiliently compressible material used for the main body 12. In some embodiments, a plurality of various inserts may be interchangeably positioned in the pair of first pockets 44 and the pair of second pockets 46. Some of the various inserts may comprise various structures and materials such as the resiliently compressible material, a heat transfer medium, a massager device, or others.

An outer casing 54 encloses the inner casing 34. The outer casing 54 comprises a pair of outer casing ventilated sections 56, each of which is positioned over an associated one of the pair of inner casing ventilated sections 36. The outer casing ventilated sections 56 define outer casing apertures 58 configured to facilitate air flow through the pair of outer casing ventilated sections 56. The outer casing 54 also defines an outer casing opening 62 which extends into an interior space of the outer casing 54. The inner casing 34 is removable through the outer casing opening 62. An outer casing closure 62 is coupled to the outer casing 54 for closing the outer casing opening 62. The outer casing closure 62 comprises a zipper but may comprise snap buttons, a drawstring, a hook-and-loop fastener, or the like.

A pair of casing connectors 64 attach the inner casing 34 to the outer casing 54 and align the inner casing ventilated sections 36 with the outer casing ventilated sections 56. Each casing connector 64 of the pair of casing connectors 64 comprises an inner mating member 66 coupled to the inner casing 34 and an outer mating member 68 coupled to the outer casing 54. The inner mating member 66 extends around an associated one of the pair of inner casing ventilated sections 36, and the outer mating member 68 extends around an associated one of the pair of outer casing ventilated sections 56.

The main body 12 is bendable about a central longitudinal axis into a folded configuration 70 in which the first blocks 30 are positioned opposite each other across a gap 72 formed by the main body 12 and the second blocks 32 are positioned opposite each other across the gap 72. A plurality of fasteners 74 is provided for securing the main body 12 in the folded configuration 70. The fasteners 74 are coupled to the outer casing 54, with a first mating member 76 of each fastener 74 positioned on a first lateral portion 80 of the outer casing 54 and a second mating member 78 of each fastener 74 is positioned on a second lateral portion 82 of the outer casing 54. The fasteners 74 are hook-and-loop connectors but may comprise snap buttons, ties, latches, or the like.

In use, the pillow assembly 10 is wrapped around the arm 86 of the user 84 with the main body 12 positioned in the folded configuration 70. The arm 86 is positioned in the gap 72 between the pair of first blocks 30 and between the pair of second blocks 32. The inserts engage the arm 86 through the respective pockets and the outer casing 54. If, as in the embodiment depicted in the figures, the inserts comprise the resiliently compressible material, the inserts cushion the arm 86 against the first and second blocks 32. The inserts may also transfer heat to or from the arm 86, massage the arm 86, or perform another treatment to the arm 86. The main body 12 serves to cushion exterior objects against the blocks.

When a compressive force is applied to the pillow assembly 10 around the arm 86, the compressive force acts on one or more of the blocks and is transferred from the one or more blocks to one or more inserts via an interior surface of the one or more block. The compressive force is therefore distributed over the entire area of the interior surface, which limits discomfort to the user 84 by forces exerted over an area smaller than the interior surface. Such forces are more likely to impinge upon blood vessels in a concentrated manner, thereby limiting blood circulation through the arm 86.

Specific uses of the pillow assembly 10 include supporting the user 84's head, supporting a companion 94's head lying near the user 84, and holding a baby on the pillow assembly 10 while breastfeeding. In each of these situations, a compressive load would be exerted directly on the arm 86 in a potentially uncomfortable manner. Wearing the pillow assembly 10 on the user 84's arm 86 will cushion the object causing the compressive load and cushion the user 84's arm 86. Such action will also distribute the compressive load as described via the blocks. Some individuals find that a chosen sleeping or resting position can inadvertently cause impingement of blood vessels in the individual's arm, and the pillow assembly 10 may also be used in such situations to ameliorate effects of poor blood circulation.

It should be particularly noted that, while four blocks, four pockets, and four inserts are described in the specification and shown in the figures, other quantities of each are contemplated by the present invention. The positions of the blocks and inserts as shown correspond to a placement of one pair of blocks and one pair of inserts around a forearm 88 of the user 84, and a placement of another pair of blocks and another pair of inserts around an upper arm 90 of the user 84. Such an arrangement allows the user 84 to freely bend the arm 86 without interference from the blocks and inserts. The central hole 24 of the main body 12 also provides room for an elbow 92 of the user 84 to be positioned when the user 84 bends the arm 86. The blocks and inserts may be sized and shaped to conform to the forearm 88, the upper arm 90, or other intended areas of engagement. The pillow assembly 10 may also be configured to adapt to a leg of the user 84 for use in a similar manner to that described.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pillow assembly for cushioning an arm of a user, the assembly comprising:

a main body comprising a resiliently compressible material configured for cushioning the arm, the main body being elongated;

a plurality of blocks being coupled to a top side of the main body, each block of the plurality of blocks comprising a rigid material;

a plurality of inserts being mounted opposite the main body across the plurality of blocks;

wherein the main body is bendable around a central longitudinal axis into a folded configuration wherein each insert of the plurality of inserts is positioned across a gap formed by the main body opposite another insert of the plurality of inserts;

wherein the main body defines a pair of first cavities and a pair of second cavities, the pair of first cavities and the pair of second cavities extending into the top side of the main body, the pair of first cavities being laterally spaced from each other with respect to the main body, the pair of second cavities being laterally spaced from each other with respect to the main body, the pair of first cavities being longitudinally spaced from the pair of second cavities with respect to the main body;

wherein the plurality of blocks including a pair of first blocks and a pair of second blocks, each first block of the pair of first blocks being positioned in an associated first cavity of the pair of first cavities, each second block of the pair of second blocks being positioned in an associated second cavity of the pair of second cavities;

wherein the main body defines a groove in the top side, the groove extending longitudinally with respect to the main body, the groove extending between the pair of first cavities and between the pair of second cavities;

a casing enclosing the main body and the plurality of blocks;

a plurality of pockets being coupled to an exterior of the casing, the plurality of pockets being positioned over the plurality of blocks, each pocket of the plurality of pockets containing an associated insert of the plurality of inserts;

wherein the main body defines a central hole which extends through the top side and a bottom side of the main body, the central hole being positioned centrally between a pair of lateral sides of the main body and between a pair of ends of the main body, further comprising:

an inner casing enclosing the main body and the plurality of blocks, the inner casing comprising a pair of inner casing ventilated sections positioned on opposing ends of the central hole of the main body, the pair of inner casing ventilated sections defining inner casing apertures configured to facilitate air flow through the pair of inner casing ventilated sections;

a plurality of pockets being coupled to an exterior of the casing, the plurality of pockets being positioned over the plurality of blocks, each pocket of the plurality of pockets containing an associated insert of the plurality of inserts; and an outer casing enclosing the inner casing, the outer casing comprising a pair of outer casing ventilated sections, each outer casing ventilated section of the pair of outer casing ventilated sections being positioned over an associated one of the pair of inner casing ventilated sections, the pair of outer casing ventilated sections defining outer casing apertures configured to facilitate air flow through the pair of outer casing ventilated sections; and a pair of casing connectors, each casing connector of the pair of casing connectors comprising an inner mating member being coupled to the inner casing and an outer mating member being coupled to the outer casing, the inner mating member extending around an associated one of the pair of inner casing ventilated sections, the outer mating member extending around an associated one of the pair of outer casing ventilated sections, the pair of casing connectors releasably securing each inner casing ventilated section with an associated outer casing ventilated section in alignment with each other.

2. The assembly of claim 1, further comprising a fastener being operable to maintain the main body in the folded configuration.

3. The assembly of claim 1, wherein each insert of the pair of first inserts and the pair of second inserts comprises the resiliently compressible material.

4. The assembly of claim 1, wherein the main body defines a plurality of through holes which extend through the top side and the bottom side, the plurality of through holes being evenly dispersed across the top side of the main body.

5. The assembly of claim 1, wherein the casing defines an inner casing, further comprising an outer casing enclosing the inner casing.

6. The assembly of claim 5, wherein the fastener comprises a first mating member coupled to a first lateral portion of the outer casing and a second mating member coupled to a second lateral portion of the outer casing.

7. A pillow assembly for cushioning an arm of a user, the assembly comprising:

a main body comprising a resiliently compressible material configured for cushioning the arm, the main body being elongated, the main body defining a pair of first cavities and a pair of second cavities, the pair of first cavities and the pair of second cavities extending into a top side of the main body, the pair of first cavities being laterally spaced from each other with respect to the main body, the pair of second cavities being laterally spaced from each other with respect to the main body, the pair of first cavities being longitudinally spaced from the pair of second cavities with respect to the main body, the main body defining a groove in the top side, the groove extending longitudinally with respect to the main body, the groove extending between the pair of first cavities and between the pair of second cavities, the main body defining a central hole which extends through the top side and a bottom side of the main body, the central hole being positioned centrally between a pair of lateral sides of the main body and between a pair of ends of the main body, the main body defining a plurality of through holes which extend through the top side and the bottom side, the plurality of through holes being evenly dispersed across the top side of the main body, each through hole of the plurality of through holes being smaller than the central hole;

a pair of first blocks and a pair of second blocks, each first block of the pair of first blocks being positioned in an associated first cavity of the pair of first cavities, each second block of the pair of second blocks being positioned in an associated second cavity of the pair of second cavities, each block of the pair of first blocks and the pair of second blocks comprising a rigid material;

an inner casing enclosing the main body, the pair of first blocks, and the pair of second blocks, the inner casing comprising a pair of inner casing ventilated sections positioned on opposing ends of the central hole of the main body, the pair of inner casing ventilated sections defining inner casing apertures configured to facilitate air flow through the pair of inner casing ventilated sections, the inner casing defining an inner casing opening which extends into an interior volume of the inner casing;

a pair of first pockets and a pair of second pockets being coupled to an exterior of the inner casing, the pair of first pockets being positioned over the pair of first blocks, the pair of second pockets being positioned over the pair of second blocks, each pocket of the pair of first pockets and the pair of second pockets comprising a pair of overlapping panels;

a pair of first inserts and a pair of second inserts, each first insert of the pair of first inserts being positioned in an associated first pocket of the pair of first pockets, each second insert of the pair of first inserts being positioned in an associated second pocket of the pair of second pockets, each insert of the pair of first inserts and the pair of second inserts comprising the resiliently compressible material;

an outer casing enclosing the inner casing, the outer casing comprising a pair of outer casing ventilated sections, each outer casing ventilated section of the pair of outer casing ventilated sections being positioned over an associated one of the pair of inner casing ventilated sections, the pair of outer casing ventilated sections defining outer casing apertures configured to facilitate air flow through the pair of outer casing ventilated sections, the outer casing defining an outer casing opening which extends into an interior space of the outer casing;

a pair of casing connectors, each casing connector of the pair of casing connectors comprising an inner mating member being coupled to the inner casing and an outer mating member being coupled to the outer casing, the inner mating member extending around an associated one of the pair of inner casing ventilated sections, the outer mating member extending around an associated one of the pair of outer casing ventilated sections, the pair of casing connectors releasably securing each inner casing ventilated section with an associated outer casing ventilated section in alignment with each other;

a plurality of fasteners being coupled to the outer casing, each fastener of the plurality of fasteners comprising a first mating member coupled to a first lateral portion of the outer casing and a second mating member coupled to a second lateral portion of the outer casing; and wherein the main body is bendable about a central longitudinal axis into a folded configuration, the plurality of fasteners being operable to secure the main body in the folded configuration.

* * * * *